US008141995B2

(12) United States Patent
Yamamoto et al.

(10) Patent No.: US 8,141,995 B2
(45) Date of Patent: Mar. 27, 2012

(54) INK JET RECORDING HEAD AND MANUFACTURING METHOD THEREFOR

(75) Inventors: Hiroyuki Yamamoto, Kawasaki (JP); Yoshiaki Kurihara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 387 days.

(21) Appl. No.: 12/447,604

(22) PCT Filed: Dec. 12, 2007

(86) PCT No.: PCT/JP2007/074356

§ 371 (c)(1),
(2), (4) Date: Apr. 28, 2009

(87) PCT Pub. No.: WO2008/072774

PCT Pub. Date: Jun. 19, 2008

(65) Prior Publication Data

US 2010/0073425 A1 Mar. 25, 2010

(30) Foreign Application Priority Data

Dec. 15, 2006 (JP) ..... 2006-338197

(51) Int. Cl.
*B41J 2/175* (2006.01)

(52) U.S. Cl. ..... 347/85; 347/65

(58) Field of Classification Search ..... 347/14, 347/19, 23, 27, 32, 37, 39, 40, 42, 43, 65–71, 347/82, 84–86
See application file for complete search history.

(56) References Cited

U.S. PATENT DOCUMENTS

| | | | | |
|---|---|---|---|---|
| 5,517,225 | A | 5/1996 | Miyazawa et al. | |
| 5,751,323 | A | 5/1998 | Swanson et al. | |
| 5,764,257 | A | 6/1998 | Miyazawa et al. | |
| 5,826,333 | A | 10/1998 | Iketani et al. | |
| 6,286,942 | B1 | 9/2001 | Miyazawa et al. | |
| 6,799,831 | B2 | 10/2004 | Inamoto et al. | |
| 7,810,914 | B2 * | 10/2010 | Owaki | 347/68 |
| 2009/0213169 | A1 | 8/2009 | Shibata et al. | |
| 2009/0237452 | A1 | 9/2009 | Kurihara et al. | |

FOREIGN PATENT DOCUMENTS

| | | |
|---|---|---|
| EP | 0 705 697 | 4/1996 |
| JP | 5-220956 | 8/1993 |
| JP | 9-183229 | 7/1997 |
| JP | 2006-289719 | 10/2006 |

* cited by examiner

*Primary Examiner* — Thinh Nguyen
(74) *Attorney, Agent, or Firm* — Fitzpatrick, Cella, Harper & Scinto

(57) ABSTRACT

An ink jet recording head comprises a support member that has an opening used for ink supply and that is formed of a resin material, a recording element board that has an ink supply port that communicates with the opening, and a wall that at least partially contacts a peripheral side face of the recording element board that is bonded to the support element. The wall is formed on the support member surrounding the opening, and is used to position the recording element board, relative to the support member, in a direction in which contact is made by the wall.

11 Claims, 10 Drawing Sheets

INK JET RECORDING HEAD AND MANUFACTURING METHOD THEREFOR

TECHNICAL FIELD

The present invention relates to an ink jet recording head used for an ink jet recording apparatus, and a manufacturing method therefor.

BACKGROUND ART

An ink jet recording apparatus is a recording apparatus of a so-called non-impact recording type, and has characteristics that almost no noise is generated during recording and that recording at a high speed and recording on various types of recording media are enabled.

For an ink jet recording head to be mounted in such an ink jet recording apparatus, the following ink discharge method is employed. For example, well known types include a method that employs an electromechanical transducing element, such as a piezoelectric element, and a method whereby ink droplets are discharged through the action of a boiling phenomenon that is obtained by rapidly heating ink using an electrothermal transducing element having a heat-generating resistor.

An ink jet recording head using an electrothermal transducing element generally includes: a discharge port, which is an opening for discharging ink droplets; an ink flow path, which communicates with the discharge port and along which ink is supplied to an area to which heat produced by the electrothermal transducing element is supplied for the ink; and a common liquid chamber.

Further, there are an ink jet recording head type that is detachable independent of an ink tank, and a cartridge type for which an ink jet recording head is integrally formed with an ink container.

FIGS. 11A and 11B are perspective views of an ink jet recording head cartridge in the prior art, respectively taken from the side where a discharge port is arranged and taken from the opposite side. This ink jet recording head cartridge is obtained by integrally forming an ink jet recording head and an ink container.

In FIGS. 11A and 11B, an ink jet recording head cartridge 601 is provided by integrally forming a recording head unit, which includes a recording element board 702, and an ink storage unit in which ink is stored. The recording element board 702 includes: a heater, which serves as an energy generating element for transducing electric energy into thermal energy; and circuit wiring for supplying, to the heater, the thermal energy received from the main body of a recording apparatus. Furthermore, a flow path forming member is also provided, which includes an ink flow path along which heat generated by the heater is to be provided for ink and an ink discharge port 703 that communicates with the ink flow path for discharging ink.

A flexible electric wiring board 706 includes wiring for transmitting an electric signal from the main body of the recording apparatus to the recording element board 702. Furthermore, at the end thereof, an external signal input terminal 707 is provided for receiving an electric signal from the main body of the recording apparatus. The flexible electric wiring board 706 is electrically connected to the two ends of the recording element board 702. And the electrically connected portions are covered with sealing members 708, and as a result, the electrically connected portions are protected from ink that attaches to the surface of the recording head unit.

Ink supplied to the recording element board 702 is stored in the ink storage unit that is constructed by mounting a lid 710 on a case 709 of the ink jet recording head cartridge 601. An ink supply path is formed in the bottom of the case 709, and ink from the ink storage unit is supplied along this ink supply path to the recording element board 702.

FIG. 12 is a cross sectional view taken along line 12-12 in FIG. 11A, and shows the surrounding structure of the recording element board 702 of the recording head unit. In FIG. 12, the recording element board 702 is shown while the flow path forming member, which includes the ink discharge port 703 and the ink flow path, the heater mounted on the recording element board 702, etc., are omitted.

A support member 802, which is a part of the case 709 for supporting the recording element board 702, includes an ink supply port 803 for supplying, to the recording element board 702, ink that is retained in the ink storage unit.

Bonding of the support member 702 to the recording element board 702 is performed by applying a thermosetting adhesive 804 to the support member 802, and then, accurately aligning the recording element board 702 with the support member 802. However, since the alignment accuracy must be maintained until the adhesive is completely cured, a UV curing adhesive 806 for temporary fixing is partially applied, and UV ray irradiation is performed for temporary fixing. Thereafter, thermal curing is performed, so that the bonding can be secured while the accuracy is maintained.

Furthermore, the flexible electric wiring board 706 is securely fixed to the support member 802 using an adhesive.

A sealing member 805, such as a resin, is employed to seal the peripheral side faces of the recording element board 702 and the support member 802. One of the reasons is that the peripheral side walls of the recording element board 702 must be protected from ink. It should be noted that a thermosetting resin that is comparatively easy to handle in a manufacturing process is generally employed as a sealing member.

The above described secure bonding method employing the adhesive 804 is a generally known means for bonding the recording element board 702 to the support member 802. For example, a temporary fixing method performed until an adhesive is completely cured is described in Japanese Patent Application Laid-Open No. H05-220956 and No. H09-183229.

As is described in Japanese Patent Application Laid-Open No. H05-220956, an adhesive for permanently fixing and a temporal tacking adhesive for temporary fixing are employed together in order to attach, to a fixing plate, the piezoelectric element unit of an ink jet recording head. Here, a UV type adhesive is employed as a temporal tacking adhesive, and a cold setting adhesive is employed as an adhesive for permanent fixing. Furthermore, as is described in Japanese Patent Application Laid-Open No. H09-183229, an adhesive for permanent fixing and a temporal tacking adhesive for temporary fixing are employed together in order to attach the heater board (a recording element board) of an ink jet recording head to a base board (a support member). According to this description, a photo-curing adhesive is employed as a temporal tacking adhesive, and a natural setting or thermosetting adhesive is employed as an adhesive for permanent fixing.

However, during the bonding process the recording element board 702 and the support member 802 are fixed together using adhesives, and the adhesives may enter the ink supply port 803. As a result, the discharge function may be deteriorated or the reliability reduced, and further, there have been cases wherein the ink supply port 803 has become clogged and the discharge of ink disabled.

In addition, in a case wherein temporary fixing is to be performed by partially applying an adhesive for the temporary fixing and photocuring the adhesive within a short period of time, the position for the application of the temporary fixing adhesive should be limited to a small gap between the peripheral side face of the recording element board 702 and the support member 802. Therefore, it is difficult to perform an application appropriately, and a reduction of a yield factor may be caused by a failure during the temporary fixing procedure. Furthermore, if adhesive is scattered during application and is attached to the surface of the recording element board 702, the discharge function will be deteriorated, and accordingly, a yield factor and reliability will be reduced.

SUMMARY OF THE INVENTION

One objective of the present invention is to provide a reliable ink jet recording head for which mounting of a recording element board mounting can be performed at a satisfactory yield factor and at a low cost, and a manufacturing method therefor.

Another objective of the present invention is to provide an ink jet recording head comprising:

a support member that has an opening used for ink supply and that is formed of a resin material;

a recording element board that has an ink support port that communicates with the opening; and a wall that at least partially contacts a peripheral side face of the recording element board that is bonded to the support element, wherein the wall is formed on the support member surrounding the opening, and is used to position the recording element board, relative to the support member, in a direction in which contact is made by the wall.

Furthermore, an additional objective of the present invention is to provide a manufacturing method, for an ink jet recording head that includes a support member, which has an opening used for ink supply and that is formed of a resin material, and a recording element board, which has an ink support port that communicates with the opening, comprising the steps of:

preparing, along a periphery of the opening of the support member that the recording element board is to abut upon, the support member on which a wall that is to abut upon the peripheral portion of the recording element substrate is formed;

thermally expanding the support member to move the wall outward, and mounting the recording element board on the support member in an area enclosed by the wall; and shrinking the support member by lowering a temperature, and temporarily fixing the recording element board to the support member using the wall that contacts the peripheral portion of the recording element board.

Further, one more objective of the present invention is to provide a manufacturing method, for an ink jet recording head that includes a support member, which has an opening used for ink supply and is formed of a resin material, and a recording element board, which has an ink support port that communicates with the opening, comprising the steps of:

bringing the recording element board into contact with the support member and, in a state wherein a contact portion of the support member is melted, pushing the recording element board into the support member, so that the entire peripheral portion of the recording element board is surrounded by the melted resin; and curing the melted resin by lowering a temperature and forming a wall that contacts the entire peripheral potion of the recording element board, and temporarily fixing the recording element board to the support member.

Further features of the present invention will become apparent from the following description of exemplary embodiments with reference to the attached drawings.

BRIEF DESCRIPTION OF THE DRAWINGS

FIG. 2A is a plan view of the obverse side of the board; FIG. 2B is a plan view of the reverse side of the board; and FIG. 2C is a plan view of the obverse side of the board before forming a flow path forming member.

FIGS. 3A and 3C are cross sectional views, and FIGS. 3B and 3D are plan views.

FIGS. 4A, 4B, 4C and 4D are cross sectional views; FIG. 4E is a plan view; and FIG. 4F is a perspective view.

FIG. 11A is a perspective view taken from the side (bottom side) where a discharge port is arranged and FIG. 11B is a perspective view taken from the opposite side (top side).

BEST MODE FOR CARRYING OUT THE INVENTION

The mode of the present invention will now be described in detail while referring to drawings.

Figure 1A:
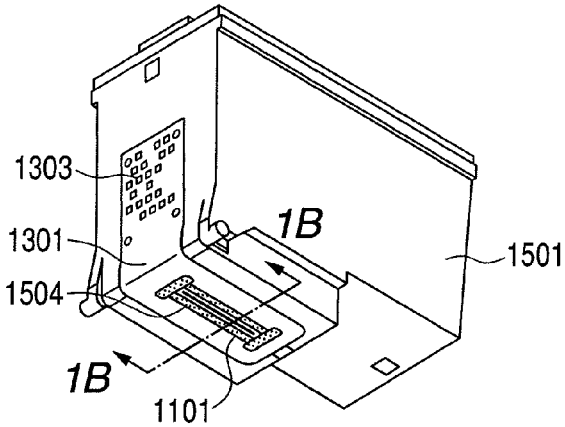
FIGS. 1A, 1B and 1C are explanatory diagrams for an ink jet recording head cartridge wherein an ink jet recording head according to one mode of the present invention is integrally formed with an ink container.
Figure 1C:
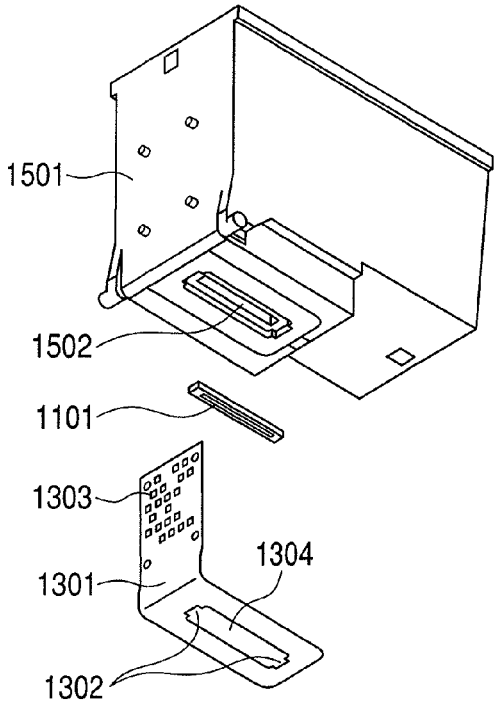
Figure 1B:
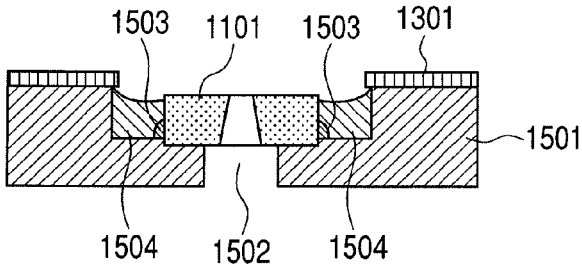
Figure 2A:
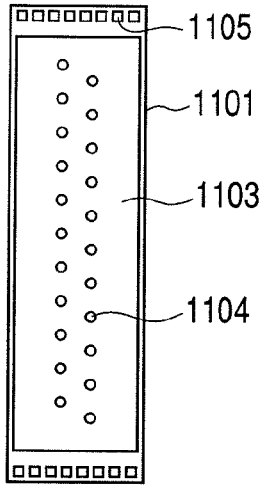
FIGS. 2A, 2B and 2C illustrate a recording element board that constitutes the ink jet recording head according to the mode of the present invention.
Figure 2B:
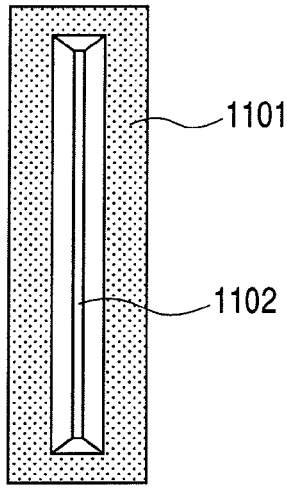
Figure 2C:
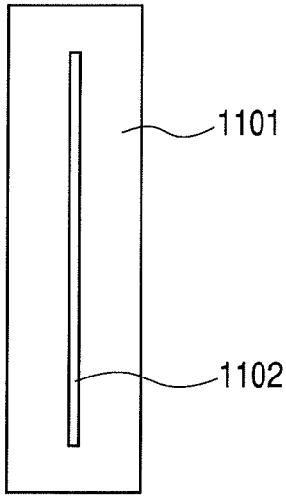

FIGS. 1A to 1C and FIGS. 2A to 2C are diagrams illustrating the structure of an ink jet recording head according to the mode of the present invention. FIG. 1A is a perspective view of an ink jet recording head cartridge wherein an ink jet recording head and an ink container are integrally formed. FIG. 1B is a cross sectional view taken along line 1B-1B in FIG. 1A, and FIG. 1C is an exploded perspective view of a recording head unit. FIG. 2A is a plan view illustrating the obverse face of a recording element board that is a constituent of the recording head unit. FIG. 2B is a plan view of the reverse face of the recording element board that is a constituent of the recording head unit. FIG. 2C is a plan view illustrating the obverse face of the recording element board before a flow path forming member is formed on the obverse face of the recording element board.

In these diagrams, a recording element board 1101 is a plate member made of a silicon (Si) material 0.625 mm thick. And on one side of the plate member, a plurality of electrothermal transducing elements (not shown), which serve as energy generating elements for discharging ink, and electric wiring (not shown), such as aluminum (Al), for supplying electric power to the individual heaters that are electrothermal transducing elements, are formed using the film deposition technique.

Further, a flow path forming member 1103 (FIG. 2A), in which a plurality of ink flow paths (not shown) and a plurality of ink discharge ports 1104 are formed in consonance with these electrothermal transducing elements, is formed on the obverse face of the recording element board 1101 using photolithography. In addition, an ink supply port 1102 (FIG. 2B) is bored through the recording element board 1101 in order to supply ink to the plurality of ink flow paths (FIG. 2C). That is, on the obverse face side of the recording element board 1101, the flow path forming member 1103 covers the opening of the ink supply port 1102, so that the ink flow paths formed inside the flow path forming member 1103 communicate with the opening of the ink supply port 1102.

An electric wiring member 1301 includes: a device hole 1304 that is an opening for the mounting of the recording element board 1101; and electrode terminals 1302 that correspond to electrodes 1105 of the recording element board 1101 (FIG. 1C). Further, an external signal input terminal 1303 is also included for receiving, from the main body of the recording apparatus, a drive control signal for the electric wiring member 1301 (FIG. 1C). The external input terminal 1303 and the electrode terminals 1302 are connected together by copper foil wiring, thereby providing the flexible electric wiring member 1301.

A support member 1501 is formed by resin formation, and in order to improve form rigidity, a resin material (denatured polyphenylene ether) used in this embodiment is a mixture of 35% by weight of a glass filler.

For the support member 1501, a material that is to be expanded by heating for temporarily fixing the recording element board 1101 and is to be shrunk by cooling is employed. Further, in the individual embodiments to be explained in detail, it is preferable that the linear expansion coefficient of the support member 1501 be greater than the linear expansion coefficient of the recording element board 1101 in order to perform appropriate temporary fixing. A heating temperature of 200° C. or lower is preferable for prevention of damage to various members and elements formed on the recording element board 1101, and 180° C. or lower is more preferable. Furthermore, in order to obtain satisfactory heating effects, a heating temperature of 80° C. or higher is preferable, and 90° C. or higher is more preferable. In one case, as in embodiment 2, which will be described later, wherein a temporary fixing wall is formed for temporary fixing, a resin that will be melted within such a temperature range is preferable. As this resin material, a thermoplastic resin can be employed, and can be, for example, not only a denatured polyphenylene ether (denatured PPE), but also polyethylene telephthalate (PET), polystyrene (PS), polypropylene (PP) or polybutylene telephthalate (PBT). In order to improve form rigidity, a reinforcing material, such as a glass filler, may be mixed in, or another material may be mixed in consonance with a desired function.

It should be noted that the term temporary fixing indicates that, in a case wherein two members are to be positioned and secured by an adhesive and it takes time for an adhesive used for permanent fixing to become effective, the two members are secured temporarily, in a short period of time, at a strength that at least does not change their positional relationship.

The support member 1501 includes an ink supply path 1502 for receiving ink supplied from an ink storage unit (FIG. 1C). Further, temporary fixing walls 1503 are formed to temporarily secure the recording element board 1101, and the temporary fixing walls 1503 and the peripheral side faces of the recording element board 1101 are covered with a sealing material 1504 (FIG. 1B). Since the sealing material 1504 is provided for the joint between the recording element board 1101 and the support member 1501, the leakage of ink can be prevented.

Embodiment 1

Figure 3A:
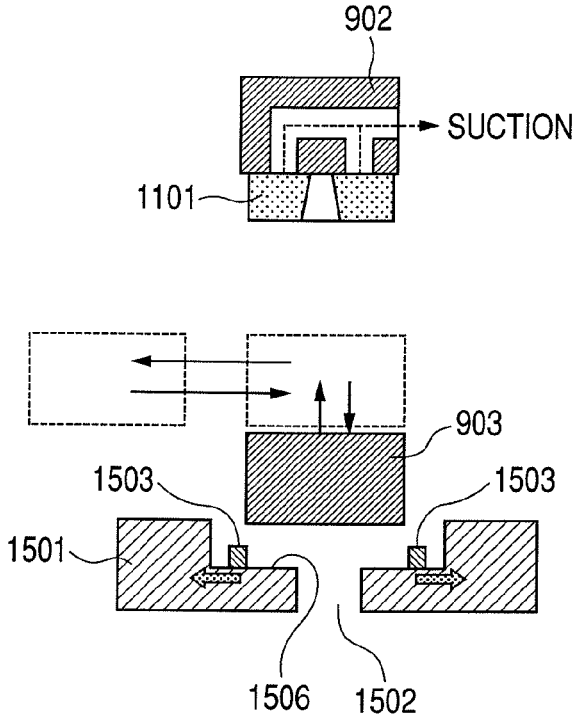
FIGS. 3A, 3B, 3C and 3D are schematic diagrams for explaining a temporary fixing method for a recording element board and a support member according to embodiment 1 of the present invention.
Figure 3B:
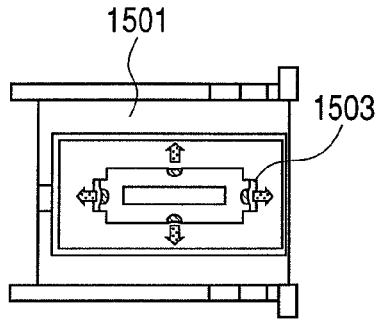
Figure 3C:
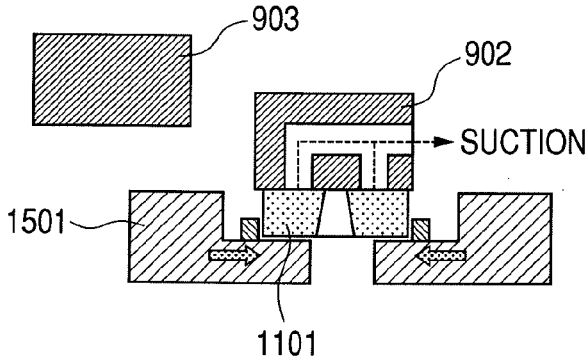
Figure 3D:
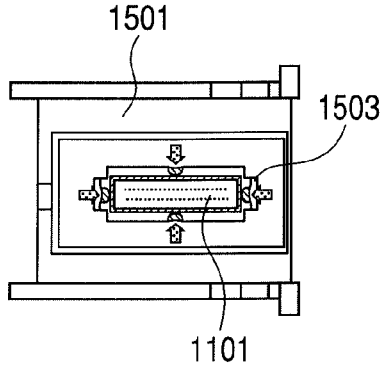

FIGS. 3A to 3D are schematic diagrams (FIGS. 3A and 3C are cross sectional views and FIGS. 3B and 3D are plan views) for explaining a temporary fixing method for the recording element board 1101 and the support member 1501 according to embodiment 1 of the present invention.

As shown in FIGS. 3A and 3B, temporary fixing walls 1503, which contact the peripheral side faces of the recording element board 1101, are formed in advance on the support member 1501. In this embodiment, the plan shape of the recording element board 1101 is rectangular, and the temporary fixing walls 1503 are formed to contact the center of the individual peripheral sides of the recording element board. In the case of this embodiment, the temporary fixing walls 1503 are located at four places; however, in order to achieve the temporary fixing purpose, when the temporary fixing walls 1503 are arranged to sandwich the recording element board 1101, two places, at the minimum, are satisfactory. On the other hand, the temporary fixing walls 1503 may be arranged at five or more places. At the least, the temporary fixing walls 1503 need only be arranged, respectively, along the two opposite sides, so that a positional relationship, in which the pressing directions, using the temporary fixing walls 1503, oppose each other, is established.

Based on the temporary fixing walls 1503, the recording element board 1101 is positioned in the in-plane direction of the face that is bonded to the support member 1501. That is, temporary fixing walls 1503 position the recording element board 1101 to the support member 1501 in a direction contacting the temporary fixing walls 1503. The plan shape of the recording element board 1101 may not only be a rectangle, but also a polygon, such as a square. Furthermore, in this embodiment, a height of about 150 μm is employed for the temporary fixing walls 1503. The appropriate height of the temporary fixing walls 1503 can be determined in accordance with forces applied by handling the apparatus, etc.

By performing the following process, the recording element board 1101 is fixed to the support member 1501 where the temporary fixing walls 1503 are formed in the above described manner.

First, the recording element board 1101, held by a suction block 902, is aligned with the support member 1501.

Then, as shown in FIG. 3A, a hot block 903, heated to about 100° C., is brought close to the support member 1501 to thermally expand a board joint portion 1506 of the support member 1501. Through the thermal expansion, as shown in FIGS. 3A and 3B, the temporary fixing walls 1503 are moved outward (directions indicated by arrows in the drawings) to increase the distances between the temporary fixing walls.

In this state, the recording element board 1101, aligned in advance, is inserted into the board joint portion 1506 of the support member 1501.

When the support member 1501 is cooled, while the recording element board 1101 is held, the support member 1501 is shrunk, and as shown in FIGS. 3C and 3D, the temporary fixing walls 1503 are moved inward (directions indicated by arrows in the drawings) to reduce the mutual distances. And the temporary fixing walls 1503 at least partially contact and press against the peripheral side faces of the recording element board 1101, and thus, temporary fixing is completed.

After temporary fixing has been performed, the electric wiring member 1301 is securely bonded to the support member 1501, and the electrode terminals 1302 of the electric wiring member 1301 and the recording element board 1101 are electrically connected. Following this, the sealing material 1504, made of a thermosetting resin, is applied to a gap between the peripheral side faces of the recording element board 1101 and the support member 1501, and is thermally cured, and thereafter, the bonding of the recording element board 1101 to the support member 1501 is completed (FIG. 1B).

Since the sealing material 1504 is applied to cover the temporary fixing walls 1503 and the peripheral side faces of the recording element board 1101, the leakage of ink from the portion where the support member 1501 and the recording element board 1101 are bonded together can be prevented.

Embodiment 2

Figure 4A:
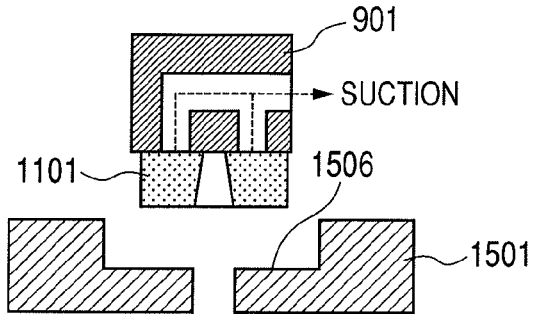
FIGS. 4A, 4B, 4C, 4D, 4E and 4F are schematic diagrams for explaining a temporary fixing method for a recording element board and a support member according to embodiment 2 of the present invention.
Figure 4B:
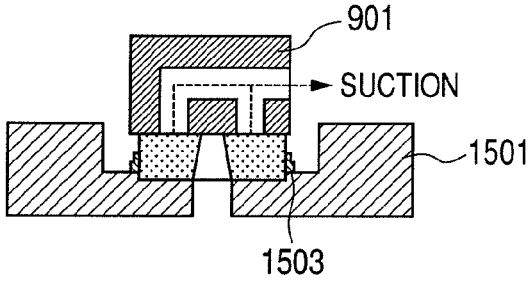
Figure 4C:
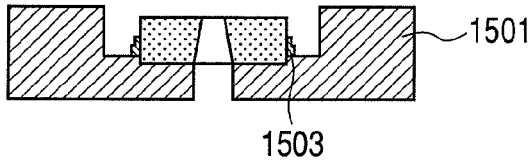
Figure 4D:
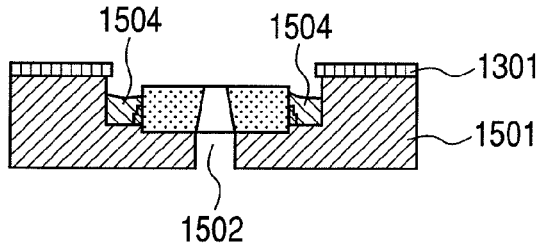
Figure 4E:
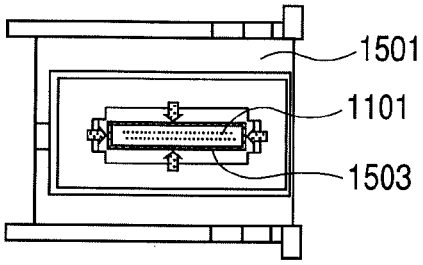
Figure 4F:
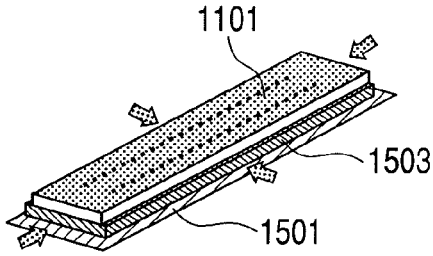

FIGS. 4A to 4F are schematic diagrams (FIGS. 4A to 4D are cross sectional views, FIG. 4E is a plan view and FIG. 4F is a perspective view) for explaining a temporary fixing method, for a recording element board 1101 and a support member 1501 according to embodiment 2 of the present invention, that is related to the manufacture of an ink jet recording head.

As shown in FIG. 4A, the recording element board 1101 is held by a hot suction block 901, and thereafter, is aligned with the support member 1501.

After the alignment procedure has been completed, the recording element board 1101 is heated until a temperature for melting the support member 1501, or higher, is attained (FIG. 4A). Here, the melting temperature of the support member 1501 of this embodiment is about 120° C. When a heating temperature is set that exceeds 200° C., the other constituents might be damaged by heat, and 150° C. or higher to 200° C. or lower is an appropriate range. In this embodiment, while taking into account the melting temperature of about 120° C. for the support member 1501, the recording element board 1101 is heated to 180° C.

Sequentially, the recording element board H1101 that is kept hot is pressed in contact with the portion around the opening of an ink supply path 1502 of the support member 1501. This pressing is performed so that a contact portion of a board joint portion 1506 of the support member H1501 is to be melted, and at the same time, the melted resin is to be extruded along the periphery of the recording element board 1101 (FIG. 4B). When the support member 1501 is cooled, the resin that was extruded along the periphery of the recording element board 1101 forms a temporary fixing wall 1503 (FIG. 4C).

In FIGS. 4E and 4F, the state is shown wherein the recording element board 1101 is mounted on the support member 1501 and the temporary fixing wall 1503 is formed along the periphery of the recording element board 1101.

Since the linear expansion coefficient of the support member 1501 is greater than the linear expansion coefficient of the recording element board 1101, after cooling, the support member 1501 shrinks more than does the recording element board 1101. As a result, the temporary fixing wall 1503 holds the periphery of the recording element board 1101 down by pressing it in a direction indicated by arrows in the drawings, and temporary fixing is enabled. This temporary fixing wall 1503 need not contact the entire peripheral side faces of the recording element board 1101, but contacts them at least partially.

In this embodiment, the temporary fixing wall 1503 is formed to attain a height of about 100 μm. It has been confirmed that when an ink jet recording head temporarily fixed in this manner is dropped from a height of 100 mm, the recording element board 1101 is still not separated from the support member 1501.

By changing the distance in which the recording element board H1101 is pressed, the height of the temporary fixing wall 1503 to be formed can be controlled, and a temporary fixing force can be adjusted. Therefore, it is simply required that the height of the temporary fixing wall 1503 be determined in accordance with the force that is applied to the support member 1501 and the recording element board 1101 during the handling of the apparatus, etc., after temporary fixing has been performed.

After the temporary fixing has been performed in the above described manner, an electric wiring member 1301 is securely bonded to the support member 1501, and electrode terminals 1302 on the electric wiring member 1301 and the recording element board 1101 are electrically connected together. Then, a sealing material 1504, made of a thermosetting resin, is applied to a gap between the peripheral side faces of the recording element board 1101 and the support member 1501, and is thermally cured, so that the bonding of the recording element board 1101 and the support member 1501 is completed (FIG. 4D).

Since the sealing material 1504 is applied to cover the temporary fixing wall 1503 and the peripheral side faces of the recording element board 1101, the leakage of ink from the portion where the recording element board 1101 and the support member 1501 are bonded together can be prevented. Further, since the temporary fixing wall 1503 is formed so as to contact all the peripheral side faces of the recording element board 1101, the sealing member 1504 does not enter the ink supply path 1502.

In a case for the forming the temporary fixing wall 1503 in a shorter period of time, the following pressing process may be performed using a suction block 902 and a hot block 903, instead of the hot suction block 901.

Figure 5A:
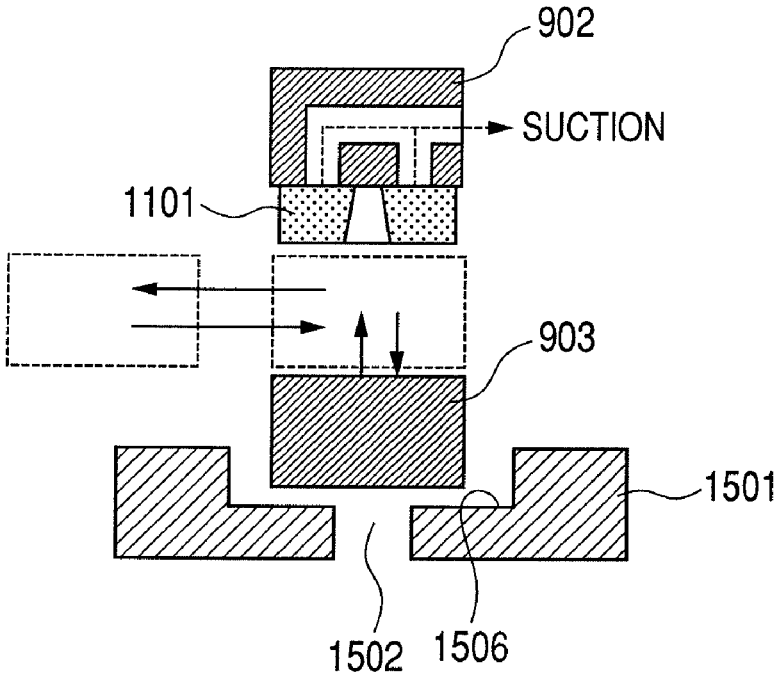
FIGS. 5A and 5B are schematic cross sectional views for explaining another temporary fixing method for a recording element board and a support member according to embodiment 2 of the present invention.
Figure 5B:
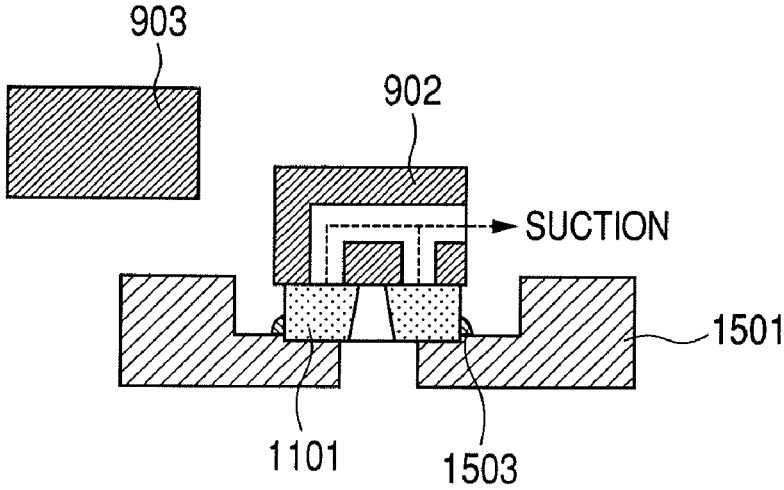

As shown in FIGS. 5A and 5B, the hot block 903 is inserted between the recording element board 1101, which is held by the suction block 902, and the support member 1501, and heats the two members at the same time (FIG. 5A).

After heating, the hot block 903 is withdrawn, and the recording element board 1101, held by the suction block 902, is pressed against the support member 1501 (FIG. 5B).

Since the recording element board 1101 can be pressed against the support member 1501 in the state wherein the support member 1501 is melted in advance, the temporary fixing wall 1503 can be formed within a shorter period of time.

Embodiment 3

Figure 6A:
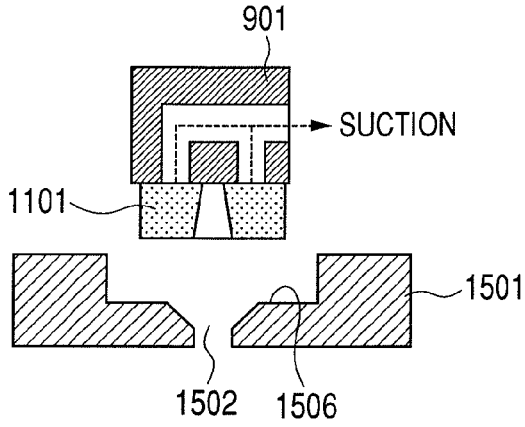
FIGS. 6A and 6B are schematic cross sectional views for explaining another temporary fixing method for a recording element board and a support member according to embodiment 3 of the present invention.
Figure 6B:
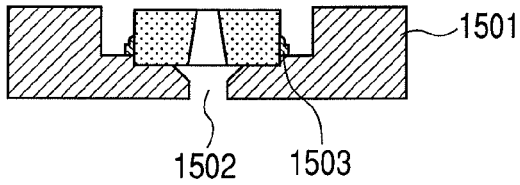

FIGS. 6A and 6B are schematic diagrams (a cross sectional view) for explaining a temporary fixing method for a recording element board 1101 and a support member 1501 according to embodiment 3 of the present invention.

As a different structure from that in embodiment 2 described above, as shown in FIG. 6A, the width of the upper opening (the board joint portion 1506 side) of an ink supply path of a support member 1501 is increased. Therefore, the amount of the support member 1501 to be melted when the recording element board 1101 is pushed into the support member 1501 (FIG. 6B) can be reduced. The remainder of the temporary fixing method is the same as the specific method for the embodiment 2, i.e., the melting of the board joint portion 1506 using the temperature of the recording element board 1101 that has been heated. As a result, the period for the melting of the support member 1501 can be shortened, and the period for temporarily fixing the recording element board 1101 to the support member 1501 can be reduced.

Further, the same effects can also be obtained when the width of the ink supply path 1502, overall, is extended; however, in a case wherein the width of the ink supply path 1502 is not increased as much as possible, from the viewpoint of the discharge characteristic, the above described mode wherein the width of only the upper portion of the ink supply path 1502 is increased is preferable.

Embodiment 4

Figure 7A:
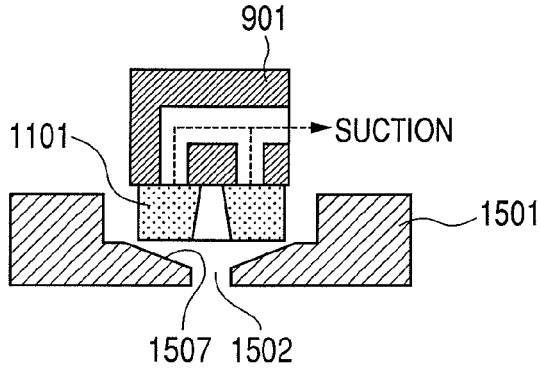
FIGS. 7A and 7B are schematic cross sectional views for explaining another temporary fixing method for a recording element board and a support member according to embodiment 4 of the present invention.
Figure 7B:
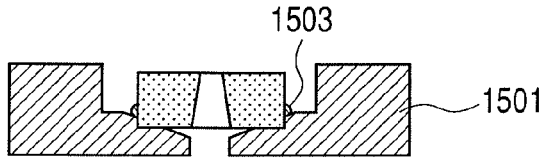

FIGS. 7A and 7B are schematic diagrams (a cross sectional view) for explaining a temporary fixing method for a recording element board 1101 and a support member 1501 according to embodiment 4 of the present invention.

As a different structure from that in the above described embodiment 2, as shown in FIG. 7A a slope 1507 is formed on a board joint portion 1506 of the support member 1501 and along the periphery of the opening of an ink supply path 1502, and is inclined downward to the opening. The slope 1507 is wide on the upper portion side (the board joint portion 1506 side) of the ink supply path 1502 of the board joint portion 1506, which the longitudinal bottom side of the rectangular recording element board 1101 is to be brought into contact with, and is narrowed in the direction in which the recording element board 1101 is to be pushed. It should be noted that the slope 1507 may be formed on the board joint portion 1506 that is to contact the short bottom side of the recording element board 1101, or the structure for the above described case employed for the longitudinal direction may together be used. The remainder of the temporary fixing method is the same as the specific method in the embodiment 2 for melting the board joint portion 1506 using the temperature of the recording element board 1101 that has been heated.

As a result, only the peripheral lower edge portions of the hot recording element board 1101 are brought into contact with the support member 1501, and are pushed in (FIG. 7B). Thus, the amount of melted support member 1501 can be reduced, and the temporary fixing of the recording element board 1101 and the support member 1501 within a shorter period of time is enabled.

Embodiment 5

Figure 8A:
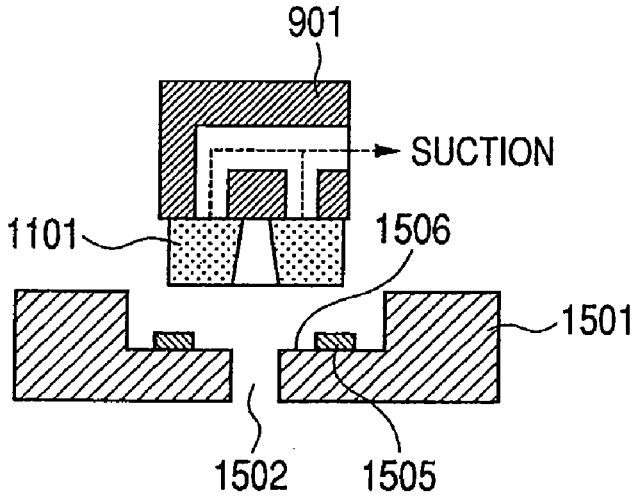
FIGS. 8A, 8B and 8C are schematic cross sectional views for explaining another temporary fixing method for a recording element board and a support member according to embodiment 5 of the present invention.
Figure 8B:
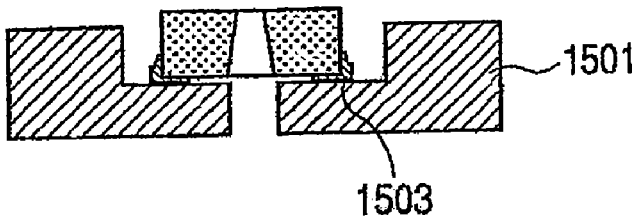
Figure 8C:
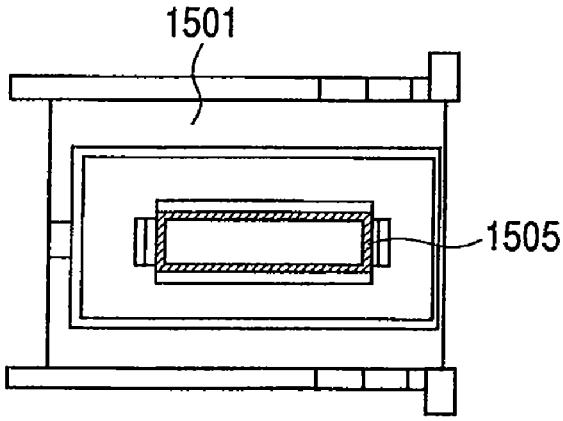

FIGS. 8A to 8C are schematic diagrams (a cross sectional view) for explaining a temporary fixing method for a recording element board 1101 and a support member 1501 according to embodiment 5 of the present invention.

As shown in FIG. 8A, a convex portion 1505 is formed in advance on a board joint portion 1506 of the support member 1501. This convex portion 1505 encloses an ink supply path 1502 that opens into the board joint portion 1506, so that the peripheral portion of a lower side face of the recording element board 1101 can contact this convex portion 1505 (FIG. 8C). The cross sectional shape of the convex portion 1505 in the bonding direction is a rectangle having a width of about 200 μm and a length of about 150 μm. The cross sectional shape may be a square. The convex portion can be formed, together, when the support member is formed.

As shown in FIG. 8B, the recording element board 1101, which is heated by a method, for example, that uses the hot block 903 and the suction block 902 in the above described embodiment 2, is pressed against the convex portion 1505 formed on the support member 1501. This heat is transferred only from the lower face of the convex portion 1505 to the support member 1501. Thus, compared with the cases in the above embodiments 2 to 4, a structure is provided wherein it is difficult for the heat of the melted portion (convex portion) to be discharged to the other members. Therefore, the temperature of the melted portion (convex portion) can be raised more quickly, and the melting period can be shortened.

The convex portion 1505 is melted and pushed down by the peripheral lower portion of the recording element board 1101, and then forms a wall that presses against the peripheral side faces of the recording element board 1101. This wall serves as a temporary fixing wall 1503 in this embodiment. Here, the temporary fixing wall is so formed that its height (where it contacts the peripheral side face of the recording element board 1101) is about 100 μm. The temporary fixing wall 1503 may not contact the entire peripheral side face of the recording element board 1101, but at least contacts part of it. It has been confirmed that even when a recording head temporarily fixed in this manner is dropped from a height of 100 mm, the recording element board still is not separated.

Embodiment 6

Figure 9A:
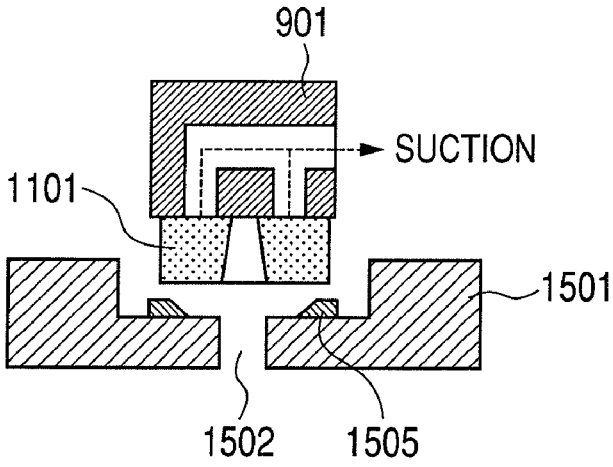
FIGS. 9A, 9B and 9C are schematic cross sectional views for explaining another temporary fixing method for a recording element board and a support member according to embodiment 6 of the present invention.
Figure 9B:
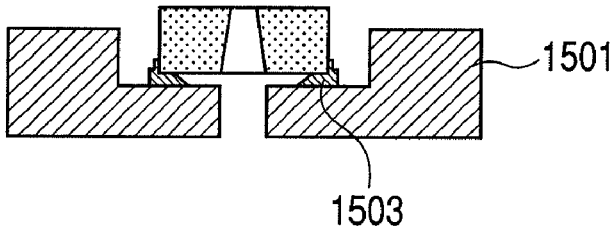
Figure 9C:
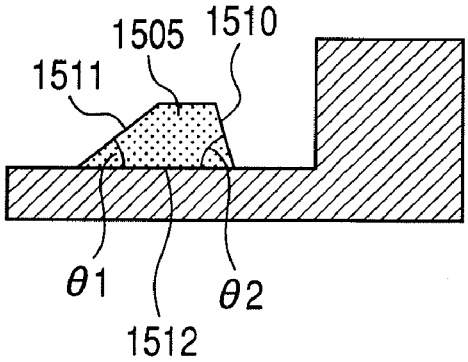

FIGS. 9A to 9C are schematic cross sectional views illustrating a temporary fixing method for a recording element board 1101 and a support member 1501 according to embodiment 6 of the present invention.

As shown in FIG. 9A, a convex portion 1505 is formed on a board joint portion 1506 of the support member 1501. A cross sectional shape (a shape in cross section perpendicular to the direction in which the convex portion is extended) is designated to be almost a trapezoid. In a trapezoidal shape, an angle θ1 formed by a convex lower face 1512 of the convex portion 1502 and a convex inner slope 1511 should be smaller than an angle θ2 formed by the convex lower face 1512 and a convex outer slope 1510 (FIG. 9C). The height of the convex portion is set at about 150 μm. This convex portion can be formed when the support member is formed. At this time, the convex lower face 1512 is included on the support member plane, on the board joint portion 1506 side of the support member 1501, around the opening of the ink supply path 1502.

Since a trapezoidal shape that is asymmetrical to the inner and outer sides is employed, the convex portion 1505 tends to be deformed in the peripheral direction of the recording element board 1101. Therefore, when the convex portion is melted, as shown in FIG. 9B, the melted resin is easily extended in the peripheral direction of the recording element board 1101, so that the temporary fixing of the recording element board 1101 is enabled using a smaller amount of a melted convex portion 1505. As a result, the period required for temporary fixing can be reduced.

It should be noted that the temporary fixing wall 1503, formed by melting and deforming the convex portion 2505, need not entirely contact the peripheral side faces of the recording element board 1101, and when at least partial contact is available, temporary fixing effects can be provided.

Embodiment 7

Figure 10A:
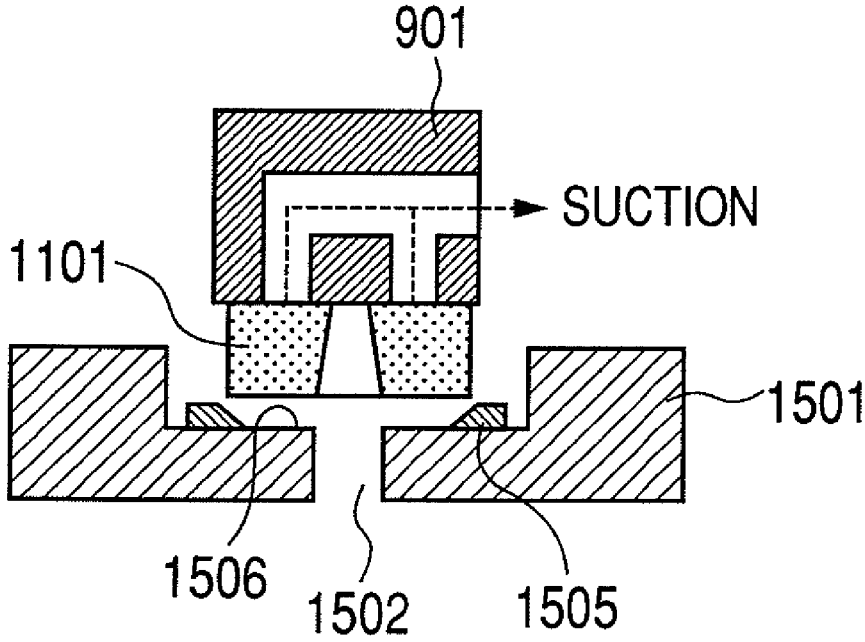
FIGS. 10A and 10B are schematic cross sectional views for explaining another temporary fixing method for a recording element board and a support member according to embodiment 7 of the present invention.
Figure 10B:
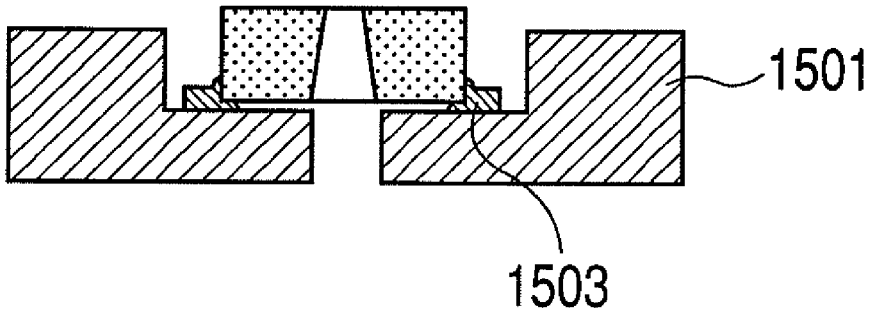
Figure 11A:
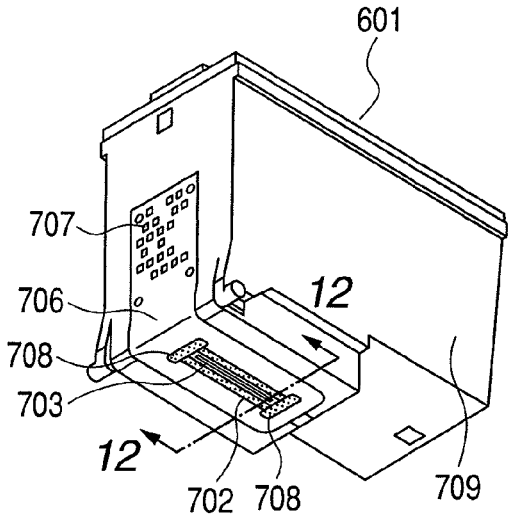
FIGS. 11A and 11B are perspective views for explaining an ink jet recording head cartridge wherein a conventional ink jet recording head and an ink container are integrally formed.
Figure 11B:
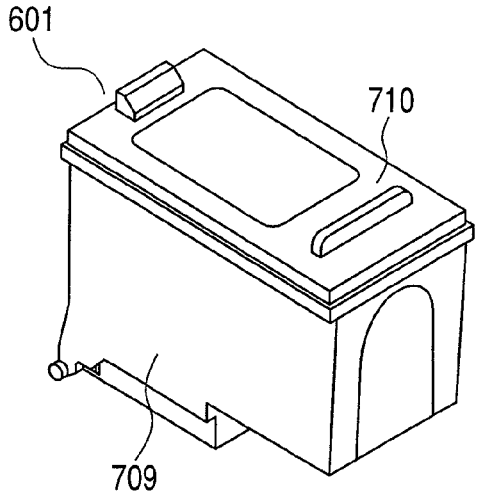
Figure 12:
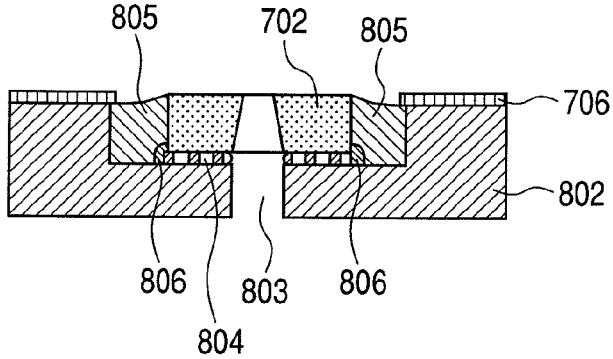
FIG. 12 is a cross sectional view, taken along line 12-12 in FIG. 11A, for explaining the conventional ink jet recording head.

FIGS. 10A and 10B are schematic cross sectional views illustrating a temporary fixing method for a recording element board 1101 and a support member 1501 according to embodiment 7 of the present invention.

As well as in embodiment 6, a convex portion 1505, having a substantially trapezoidal shape, and including a trapezoidal shape, is formed on the support member 1501.

This convex portion 1505 having an almost trapezoidal shape is positioned so that its inner slope contacts the peripheral lower edge portion of the recording element board 1101 (FIG. 10A). With this structure, only the lower peripheral edges of the recording element board 1101 that is heated are brought into contact with the convex inner slope of the convex portion 1505 having a substantially trapezoidal shape, and are pushed in (FIG. 10B). This convex portion can together be formed when the support member is formed.

As a result, the amount of the melted support member 1501 can be reduced even more, and the temporary fixing of the recording element board 1101 to the support member 1501 in a shorter period of time is enabled.

It should be noted that a temporary fixing wall 1503, formed by melting and deforming the convex portion 1505, may not contact the whole of the peripheral side faces of the recording element board 1101, and when at least a partial contact is available, temporary fixing effects can be provided.

By performing the individual processes described above, the ink jet recording head can be completed.

In addition, the loading of ink into the ink storage unit, the bonding of the lid, etc., are performed, and the ink jet recording head cartridge is completed.

According to the individual embodiments described above in detail, since an adhesive is not employed for bonding the recording element board and the support member, the processing and the cost related to an adhesive are not required, and the manufacturing cost can be reduced. Further, various problems that must be resolved in a case involving the use of an adhesive can be avoided, and the yield factor and the reliability can be improved. Thus, it is possible to provide a reliable ink jet recording head that can be produced at a satisfactory yield factor and at a low cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-338197, filed Dec. 15, 2006 which is hereby incorporated by reference herein in its entirety.

The invention claimed is:

1. A manufacturing method, for an ink jet recording head that includes a support member, which has an opening used for ink supply and that is formed of a resin material, and a recording element board, which has an ink supply port that communicates with the opening, comprising the steps of:

preparing, along a periphery of the opening of the support member that the recording element board is to abut upon, the support member on which a wall that is to abut upon the peripheral portion of the recording element substrate is formed;

thermally expanding the support member to move the wall outward, and mounting the recording element board on the support member in an area enclosed by the wall; and shrinking the support member by lowering a temperature, and temporarily fixing the recording element board to the support member using the wall that contacts the peripheral portion of the recording element board.

2. A manufacturing method, for an ink jet recording head that includes a support member, which has an opening used for ink supply and is formed of a resin material, and a recording element board, which has an ink supply port that communicates with the opening, comprising the steps of:

bringing the recording element board into contact with the support member and, in a state wherein a contact portion of the support member is melted, pushing the recording element board into the support member, so that the entire peripheral portion of the recording element board is surrounded by the melted resin; and curing the melted resin by lowering a temperature and forming a wall that contacts the entire peripheral portion of the recording element board, and temporarily fixing the recording element board to the support member, wherein the pushing-in step is a step of, while keeping the recording element board hot, pushing in the recording element board contacting a convex portion that is arranged on a portion of the support member and is to be bonded to the recording element board, and of melting a part of the convex portion arranged on the support member, so that a wall that is to contact a peripheral portion of the recording element board is to be formed.

3. A manufacturing method according to claim 2, wherein a cross-sectional shape of the convex portion formed on the support member is almost a trapezoid, and an angle formed by a lower face of the convex portion and an inner slope of the convex portion is smaller than an angle formed by the lower face of the convex portion and an outer slope of the convex portion.

4. A manufacturing method according to claim 2, wherein a cross-sectional shape of the convex portion formed on the support member is almost a trapezoid, and lower peripheral edges of the recording element board are brought into contact only with the inner slope of the convex portion.

5. An ink jet recording head comprising:

a support member that has an opening used for ink supply and that is formed of a resin material;

a recording element board that has an ink supply port that communicates with the opening; and a wall that at least partially contacts a peripheral side face of the recording element board that is bonded to the support member, wherein the wall is formed on the support member surrounding the opening, and is used to position the recording element board, relative to the support member, in a direction in which contact is made by the wall, and wherein the wall is formed by melting a part of a convex portion, which is arranged on a joint portion of the support member to which the recording element board is to be bonded, and by pushing the recording element board in the convex portion.

6. An ink jet recording head according to claim 5, wherein an angle formed by a lower face of the convex portion and an inner slope of the convex portion is smaller than an angle formed by the lower face of the convex portion and an outer slope of the convex portion.

7. An ink jet recording head according to claim 5, wherein an inner slope of the convex portion melts a portion that contacts peripheral lower edges of the recording element board.

8. An ink jet recording head according to claim 5, wherein the wall is integrally formed with the support member.

9. An ink jet recording head according to claim 5, wherein a linear expansion coefficient of the support member is greater than a linear expansion coefficient of the recording element board.

10. An ink jet recording head according to claim 5, wherein the wall contacts at least one location on each of two opposite sides of the recording element board having a rectangular shape, so that a positional relationship in which the opposite walls are pressed in opposing directions is established.

11. An ink jet recording head according to claim 5, wherein the wall contacts the entire peripheral portion of the recording element board.

* * * * *